US006397898B2

(12) United States Patent
Lindblom

(10) Patent No.: US 6,397,898 B2
(45) Date of Patent: Jun. 4, 2002

(54) YARN SUPPLY DRAW OUT REGULATOR FOR A WEAVING MACHINE

(75) Inventor: Bo Lindblom, Osby (SE)

(73) Assignee: Texo AB, Almhult (SE)

( * ) Notice: Subject to any disclaimer, the term of this patent is extended or adjusted under 35 U.S.C. 154(b) by 0 days.

(21) Appl. No.: 09/731,282

(22) Filed: Dec. 7, 2000

(30) Foreign Application Priority Data

Dec. 7, 1999 (SE) ..... 9904442

(51) Int. Cl.[7] ..... D03D 47/34; B65H 63/032
(52) U.S. Cl. ..... 139/194; 139/450
(58) Field of Search ..... 139/194, 450, 139/370.1

(56) References Cited

U.S. PATENT DOCUMENTS 4,298,033 A 11/1981 Takahashi et al. ..... 139/450
5,476,122 A * 12/1995 Schuster et al. ..... 139/194
5,544,680 A * 8/1996 De Ro ..... 139/194
5,662,148 A 9/1997 Jacobsson et al. ..... 139/450
5,725,029 A * 3/1998 Loehr et al. ..... 139/194

FOREIGN PATENT DOCUMENTS

EP 0 357 975 A2 3/1990
EP 0 570 875 A2 11/1993

* cited by examiner

*Primary Examiner*—Andy Falik
(74) *Attorney, Agent, or Firm*—Connolly Bove Lodge & Hutz, LLP

(57) ABSTRACT

A regulator works with a thread or yarn supply which is intended to provide a draw-out length of the thread or the yarn which is dependent on the one hand on the size of the supply and on the other hand on an assumed or adjusted thread tension in the draw-out thread or the draw-out yarn. A load cell is arranged so as to sense the actual thread tension in the drawn-out thread and to, supply to the regulator information for changing the size of the thread stock when the actual thread tension deviates from the assumed or previously adjusted thread tension (the desired value). The load cell can also function as a pick monitor.

56 Claims, 3 Drawing Sheets

YARN SUPPLY DRAW OUT REGULATOR FOR A WEAVING MACHINE

TECHNICAL FIELD

The present invention relates to an arrangement for a regulator which works with a thread or yarn supply which is intended to provide a draw-out length of the thread or the yarn which is dependent on the one hand on the size of the supply and on the other hand on an assumed thread tension in the drawn-out thread or the drawn-out yarn.

STATE OF THE ART

It is already well-known to use regulators in connection with textile machines of various types, for example for weaving machines. The role of the regulator is, before each drawing-out function or pick in the machine, to accumulate a thread or yarn supply from a thread or yarn magazine, which supply represents the draw-out length. The purpose of the regulator is that, during the drawing-out function, it is intended to provide a constant thread tension in the drawn-out thread, which is to result in high quality of the woven product.

It is also known to arrange regulators so as to be capable of taking up different quantities of thread or yarn so that one and the same regulator can perform weaving functions with different thread lengths, that is to say the regulator can be adjusted so as to be loaded with different quantities of thread or yarn. During weaving in a case in point, the regulator is therefore adjusted so as to be capable of, in its thread or yarn supply, bringing about a draw-out length of the thread/yarn which corresponds to the weaving case concerned. The draw-out length is in this connection related to both the size of the supply and an assumed thread tension (a desired value) with which the system is to work in the weaving or product-manufacturing case in question.

DESCRIPTION OF THE INVENTION
TECHNICAL PROBLEM

Increasingly high standards are, however, set for the products which are manufactured using the textile/weaving machines in question. In this connection, it has also been found that if attempts are made to fix and maintain the assumed thread or yarn tension by means of the function of the regulator and various arrangements associated with the regulator, the problem exists of accurately fixing the actual thread tension in and during each product-manufacturing case. Various factors can change the thread or yarn tension, for example the functions of shuttles, projectiles, warp threads, patterns etc. This can lead to a certain compensation of the draw-out length, that is to say the size of the supply, taking place by virtue of the draw-out thread being stretched differently during the various thread or yarn traverses. This results in the threads or yarns being tensioned to varying degrees in the woven material, which results in the product failing to meet the desired quality requirements. The invention aims to solve this problem and proposes an adjustment function for the size of the thread or yarn supply during an adjustment stage and/or continuously during manufacturing of the product in the machine in question. In this connection, in each adjustment case, the thread or yarn can be sensed during a pick and regulation of the thread or yarn tension can take place for the next pick etc.

There is also a need to be able to indicate thread or yarn discontinuity in a manner which is technically simple and preferably integrated into the components used. The invention also solves this problem.

There is also a requirement in this context that previously known components can be used and that machines which are already installed and set up can be provided with the new facility without excessive rebuilding. The invention also solves this problem.

THE SOLUTION

An arrangement according to the invention can be considered to be characterized mainly in that a) a load cell is arranged so as to sense the actual thread tension in the drawn-out thread or the drawn-out yarn and to supply to the regulator information for changing the size of the thread or yarn stock when the actual thread tension deviates from the assumed thread tension, and/or b) the load cell supplies pick-monitoring information by means of which the load cell provides information about thread or yarn discontinuity occurring on the thread or the yarn, about whether the gripping function of the projectile or shuttle is operating etc.

In embodiments of the invention, the information for changing the size of the thread or yarn stock brings about a reduction in the diameter of the thread or yarn supply of the regulator so that, in the event of the actual thread tension being lower than an assumed thread tension, the diameter of the thread or yarn supply/the regulator is reduced in order to increase the tension in the thread/the yarn during the next pick. It is also a feature of said embodiments that the information for changing the size of the thread or yarn stock brings about an increase in diameter in the thread supply of the regulator so that, in the event of the actual thread tension being higher than an assumed thread tension, the diameter of the thread or yarn supply/the regulator is increased in order to reduce the tension in the thread/the yarn during the following pick. The regulator receives said size-changing information as soon as the actual thread tension deviates from the assumed thread tension or the latest thread tension read by the load cell. The regulator and the load cell or the load cells can be arranged in a weaving machine for flat-woven wire. A shuttle or projectile is arranged so as to perform the drawing out of the thread from the thread supply of the regulator. The load cell can be arranged at the exit of the regulator for thread or yarn delivery. Each load cell can be connected to the control unit of the machine/weaving machine, which senses the information signal of the load cell and supplies a control signal depending on the sensing to the regulator. The load cell can also provide a thread-monitoring information signal to stop circuits in the machine (and/or, if appropriate, the regulator) in the event of discontinuity occurring in the thread/the yarn.

ADVANTAGES

As a result of the proposals made above, uniform thread or yarn lengths with the same thread tensions are obtained in the various draw-out threads or draw-out yarns in the material manufactured irrespective of the mechanical circumstances or conditions prevailing during manufacture of the material or product, for example the weaving. Load cells well-known per se can be used together with existing regulators, which guarantees reliable and financially advantageous operation. A simple pick-monitoring arrangement can in this connection also be obtained in the machine in question (regulator).

DESCRIPTION OF THE FIGURES

A for the present proposed arrangement which has the characteristics significant of the invention will be described below with simultaneous reference to the appended drawings, in which.

DETAILED EMBODIMENT

Figure 1:
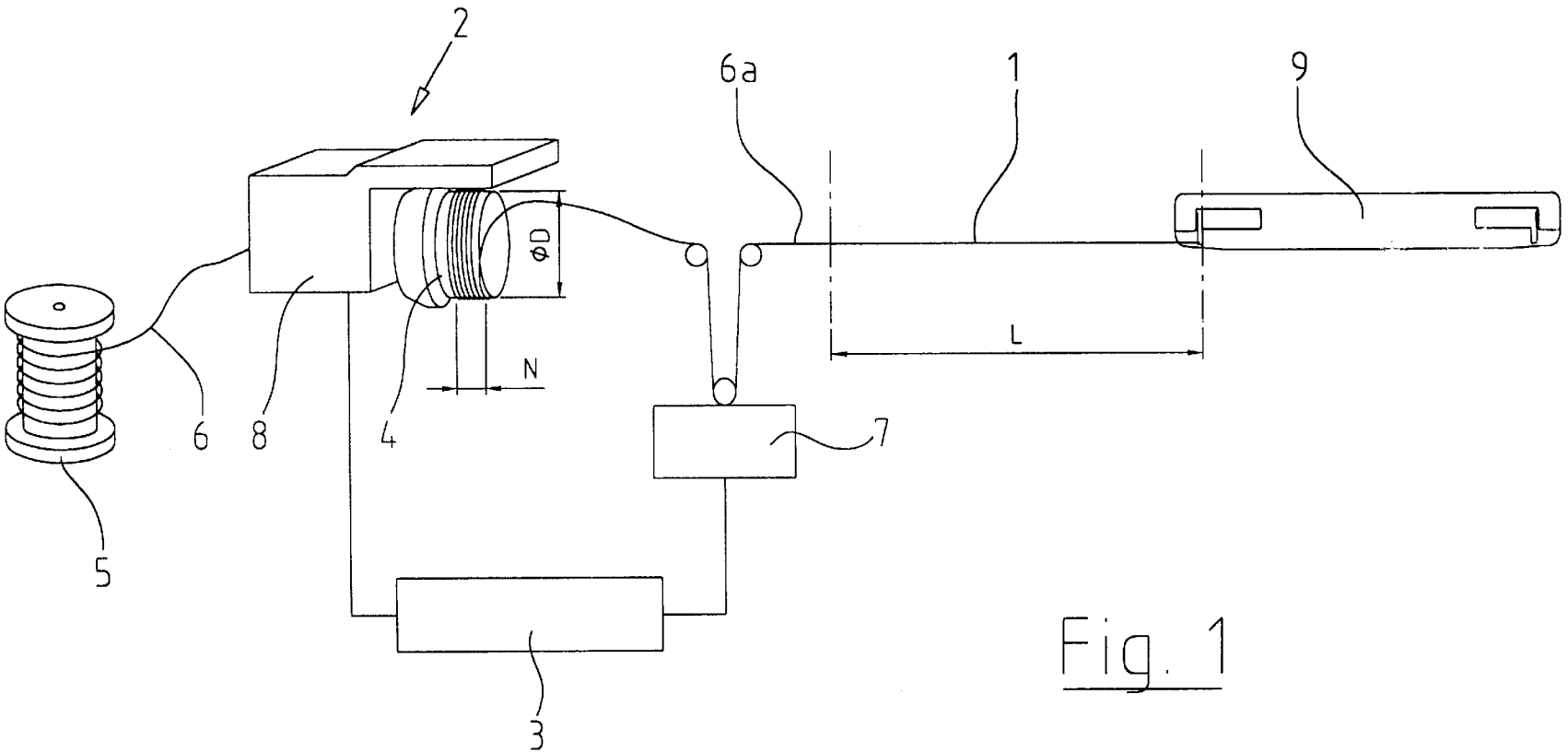
FIG. 1 shows a diagrammatic side view of the drawing-out of a thread from a regulator performed by a shuttle or projectile.

In FIG. 1, reference number 1 designates a draw-out thread which has been drawn out with an assumed or previously adjusted thread tension, that is to say a desired value. The thread length of the thread 1 is indicated by L. A regulator arrangement is shown by 2. Control equipment 3 is also included. A regulator forming part of the arrangement is shown by 4 and a diagrammatically represented thread magazine by 5. Incoming thread or yarn for the regulator is indicated by 6. The outgoing thread or yarn portion is shown by 6*a* and a load cell arrangement is shown by 7. The regulator arrangement can comprise a means 8 which is controlled by the equipment 3 and, depending on controls from the equipment 3, changes the size of the yarn supply of the regulator. The regulator is of the type which works with a constant number of coils of thread or yarn. The size of the supply is therefore varied by changing a diameter D. The portion is drawn out by a shuttle or projectile 9. According to the invention, the actual thread tension is sensed and the quantity of thread or yarn supplied is changed depending on the sensing so that the thread or yarn tensions are changed so as to be the same in the various instances of drawing-out.

Figure 2:
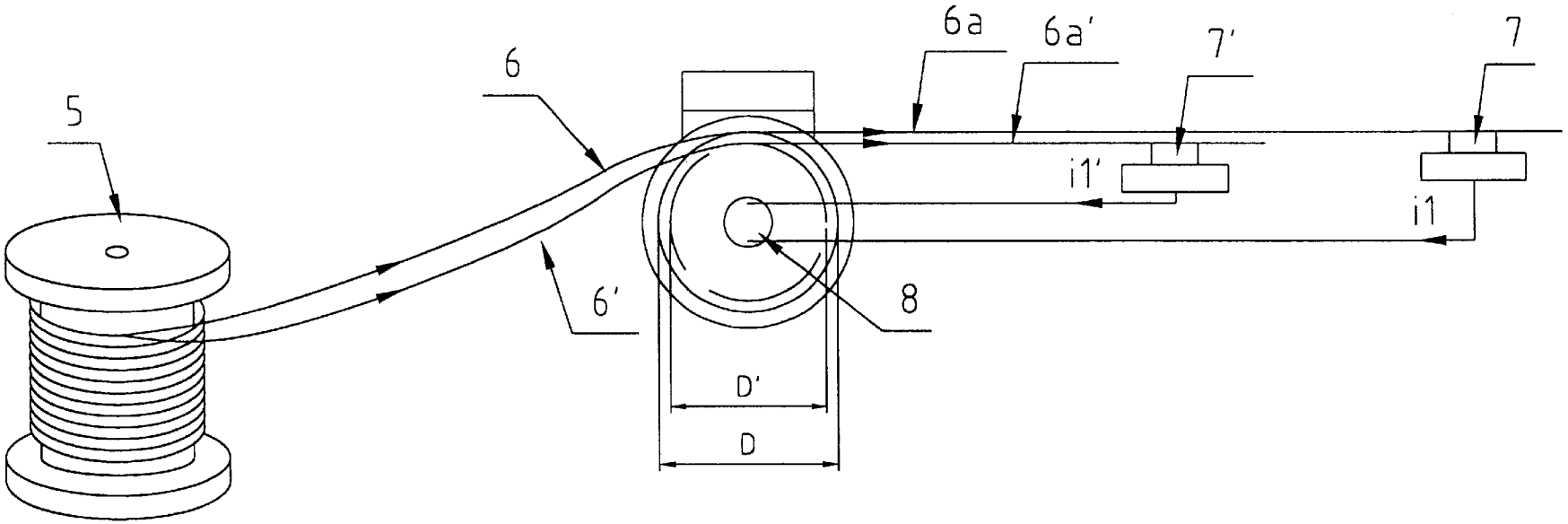
FIG. 2 shows a diagrammatic end view of a regulator with a thread or yarn supply obtained from a thread or yarn magazine and a thread or a yarn running out, which is sensed by a load cell which controls the diameter of the regulator and thus the size of the thread or yarn supply.

FIG. 2 shows that the regulator is of the type which can vary its diameter for the thread or yard supply in question. In FIG. 2, a first line indicates the contour which gives a first diameter D. Depending on control signals from control unit 15, this diameter can be changed to D' which is indicated by a broken circular line. FIG. 2 also shows diagrammatically the thread or yarn magazine from which the regulator obtains thread or yarn for accumulating in its temporary thread or yarn supply which is represented by a number of thread or yarn coils on the regulator.

It is clear that if the regulator works with a thread or yarn supply which is to be contained within a predetermined number of coils, the thread or yarn supply is changed in the event of the diameter of the regulator changing, for example from diameter D to diameter D'. Thread or yarn quantities which represent draw-out lengths can therefore be obtained on the adjustable regulator.

According to the idea of the invention, a load cell 7 is to be used to sense the thread tension in the outgoing thread or yarn portion 6*a*. In the event that the sensed thread tension in the portion 6*a* deviates from an assumed or previously adjusted thread tension with which the thread portion 6*a* is expected to be drawn out, the load cell supplies information (represented by i1 in FIG. 2) to a supply-adjusting means 8 or a supply adjust unit which changes the diameter of the thread or yarn stock of support found in original claim 8 the regulator, that is to say changes diameter D to another diameter D' to another diameter etc.

Reference numbers 6' and 6*a*' represent thread or yarn being fed onto the regulator when the supply of the latter has the diameter D'. It is also noted to be noted that the thread or yam being fed onto the regulator from the magazine 5 and the thread or yarn feeding-out functions of the regulator are in principle different from one another and that the diagram shown in FIG. 2 is only explanatory in nature (cf FIG. 1). If a number of load cells (e.g., 7, 7') are used, each load cell can supply information (represented by i1' in FIG. 2) about a supply change in the regulator. The load cells are supplied with power in a manner known per se via the electricity supply of the machine in question.

In one embodiment, the tension in the thread is sensed during a first pick, adjustment of the tension in the thread or the yarn then taking place in one or more following pick(s).

Figure 3:
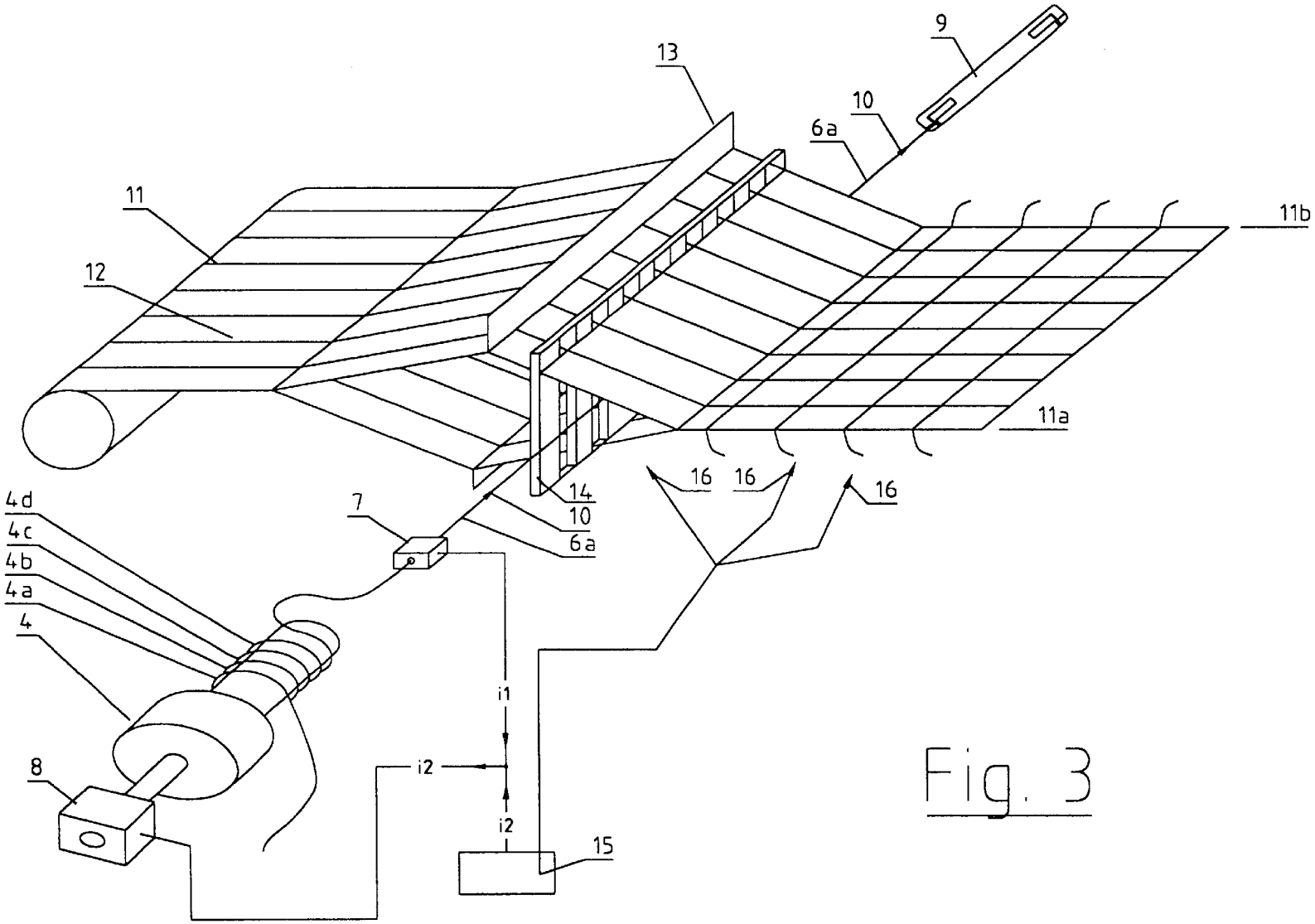
FIG. 3 shows in perspective at an angle from above the regulator according to FIG. 2 arranged in a textile machine which is shown diagrammatically and can consist of a weaving machine.

In FIG. 3, the thread or yarn supply of the regulator 4 is represented by a predetermined number of thread or yarn coils 4*a*, 4*b*, 4*c* and 4*d*. As above, the size of the thread or yarn supply is changed by changing the diameter of the regulator or the coils, the number of coils always being the same in the various traverses. The draw-out thread 6*a* is drawn out by the projectile or the shuttle 9 of a type known per se, which projectile or shuttle moves in the direction of the arrows 10. The weaving machine is symbolized by 11. The traverse of the projectile or the shuttle takes place from the first side 11*a* of the weaving machine to its second side 11*b* or vice versa. The weaving machine is also represented by a number of warp threads 12, a heald shaft arrangement 13 and a reed arrangement 14. As far as the principle and the construction are concerned, the weaving machine can be of a type known per se, and reference is made to, inter alia, the TM 300 and TM 400 weaving machines sold on the general market by TEXO AB, Sweden. Also shown in FIG. 3 is a control unit 15 of a type known per se, which controls the functions in the machine 11, which control is indicated by arrows 16. The load cell 7 can be connected to the control unit 15 which senses the sensed control information i1 from the load cell and, depending on this sensing, sends a control signal i2 to the means or the unit 8, which latter information is dependent upon the first sensed information.

By way of alternative or complement, one or more load cells 7 can be used as a pick monitor, each load cell sensing whether a draw-out thread or a draw-out yarn is being produced or is making a traverse at all, that is to say whether there is a fault in the drawing-out or the transfer function in the machine. Such faults may be thread or yarn discontinuity, faults in the gripping function of the shuttle or the projectile etc. The signal i1 may therefore consist of pick-monitoring information which is received in the control unit 15 which, depending on the information received, sends stop signal information to the machine (cf. number 16 in FIG. 3) and/or information to the alarm panel of the machine and/or information (for example stop information) to the regulator etc.

The invention is not limited to the embodiments shown above by way of example but can be modified within the scope of the patent claims below.

What is claimed is:

1. Arrangement for a regulator which works with a thread or yarn supply which provides a draw-out length of the thread dependent on the size of the supply and on an assumed thread or yarn tension in the drawn-out thread, comprising:

a load cell;

a regulator; and a control unit between said load cell and said regulator, wherein said load cell is arranged to either sense an actual thread tension in the drawn-out thread and to supply to the regulator, via the control unit, information for changing a size of the thread stock when the actual thread tension deviates from either of the assumed thread tension or the adjusted thread tension; or said load cell is arranged to supply pick-monitoring information to indicate when there is a fault or a discontinuity in the thread or the yarn or that a gripping function is not operating, or both.

2. Arrangement according to claim 1, wherein the information for changing the size of the thread or yarn stock brings about a reduction in a diameter of the thread or yarn supply of the regulator so that, if the actual thread tension is lower than the assumed or adjusted thread tension, the diameter of the thread or yarn supply of the regulator is reduced.

3. Arrangement according to claim 2, wherein the information for changing the size of the thread stock brings about an increase in the diameter of the thread or yarn supply of the regulator so that, if the actual thread tension is higher than at least one of the assumed thread tension and the adjusted thread tension, the diameter of the thread or yarn supply of the regulator is increased.

4. Arrangement according to claim 2, wherein the regulator is adapted to receive said information for changing the size when the actual thread tension deviates from at least one of the assumed thread tension and a latest thread tension read by the load cell.

5. Arrangement according to claim 2, wherein the regulator and the load cell are included in a machine for weaving flat-woven wire.

6. Arrangement according to claim 1, wherein the information for changing the size of the thread stock brings about an increase in a diameter of the thread or yam supply of the regulator so that, if the actual thread tension is higher than at least one of the assumed thread tension and the adjusted thread tension, the diameter of the thread or yarn supply of the regulator is increased.

7. Arrangement according to claim 6, wherein the regulator is adapted to receive said information for changing the size when the actual thread tension deviates from at least one of the assumed thread tension and a latest thread tension read by the load cell.

8. Arrangement according to claim 6, wherein the regulator and the load cell are included in a machine for weaving flat-woven wire.

9. Arrangement according to claim 1, wherein the regulator is adapted to receive said information for changing the size of the thread stock when the actual thread tension deviates from at least one of the assumed thread tension and a latest thread tension read by the load cell.

10. Arrangement according to claim 9, wherein the regulator and the load cell are included in a machine for weaving flat-woven wire.

11. Arrangement according to claim 1, wherein the regulator and the load cell are included in a machine for weaving flat woven wire.

12. Arrangement according to claim 11, wherein a shuttle or projectile is arranged so as to perform the drawing out of the thread from the thread supply of the regulator.

13. Arrangement according to claim 1, wherein the load cell senses an information signal of the load cell and the control unit supplies a control signal to a supply-adjusting means of the regulator based upon the information signal.

14. Arrangement according to claim 1, wherein, based on the pick-monitoring information, a signal is sent to at least one of a stop circuit coupled to the regulator, and an alarm panel.

15. Arrangement according to claim 1, wherein said regulator changes a size of the thread or yarn stock based on the information sensed by the load cell.

16. Arrangement according to claim 1, wherein said control unit receives the information from the load cell and sends a signal based on the information to the regulator.

17. Arrangement according to claim 1, further comprising a projectile or shuttle, wherein the projectile or shuttle is arranged to draw out the thread or yarn supply.

18. Arrangement for a regulator for thread or yarn delivery which works with a thread or yarn supply to provide a draw-out length of the thread dependent on a size of the thread or yarn supply and on an assumed thread or yarn tension in a drawn-out thread, said arrangement comprising:

a load cell arranged to sense an actual thread tension in the drawn-out thread and to supply, via a control unit, information for changing a size of the thread stock to the regulator when the actual thread tension deviates from at least one of the assumed thread or yarn tension and an adjusted thread or yarn tension.

19. Arrangement according to claim 18, wherein the information for changing the size of the thread or yarn stock brings about a reduction in a diameter of the thread or yarn supply of the regulator so that, if the actual thread tension is lower than the assumed or adjusted thread tension, the diameter of the thread or yarn supply of the regulator is reduced by a supply-adjusting unit of the regulator.

20. Arrangement according to claim 19, wherein the information for changing the size of the thread stock brings about an increase in a diameter of the thread or yarn supply of the regulator so that, if the actual thread tension is higher than at least one of the assumed thread tension and the adjusted thread tension, the diameter of the thread or yarn supply of the regulator is increased by a supply-adjusting unit of the regulator.

21. Arrangement for a regulator according to claim 18, wherein the load cell is arranged at an exit of the regulator.

22. Arrangement according to claim 18, wherein said regulator changes the size of the thread or yarn stock based on the information supplied by the load cell.

23. Arrangement according to claim 18, wherein said control unit receives the information sensed by the load cell and transmits a signal to the regulator to either increase or decrease a diameter of the thread or yarn stock based on the information.

24. Arrangement according to claim 18, further comprising a projectile or shuttle, wherein the projectile or shuttle is arranged to draw out the thread or yarn supply.

25. Arrangement for a regulator for thread or yarn delivery which works with a thread or yarn supply to provide a draw-out length of the thread dependent on a size of the thread or yarn supply and on an assumed thread or yarn tension in a drawn-out thread, said arrangement comprising:

a load cell arranged to supply pick-monitoring information, wherein the load cell indicates either that there is a fault or a discontinuity in the thread or the yarn, or that a gripping function is not operating, or both.

26. Arrangement for a regulator according to claim 25, wherein the load cell is arranged at an exit of the regulator.

27. Arrangement according to claim 25, wherein said regulator stops the thread or yarn from being drawn-out based on the pick monitoring information.

28. Arrangement according to claim 25, wherein said control unit sends a signal to stop the regulator when the gripping function is not operating.

29. Arrangement for a regulator for thread or yarn delivery which works with a thread or yarn supply which provides a draw-out length of the thread dependent on a size of the thread or yarn supply and on an assumed thread or yarn tension in a drawn-out thread, the arrangement comprising:

a load cell arranged at an exit of a regulator to either or both sense an actual thread tension in the drawn-out thread and to supply to the regulator, via a control unit, information for changing a size of the thread stock when an actual thread tension deviates from at least one of the assumed thread or yarn tension and an adjusted thread or yarn tension, or to supply pick-monitoring information from the load cell which indicates that there is at least one of a fault in the thread or the yarn, a discontinuity in the thread or the yarn, and an indication that a gripping function is not operating.

30. Arrangement according to claim 29, wherein the information for changing the size of the thread or yarn stock brings about a reduction in a diameter of the thread or yarn supply of the regulator so that, if the actual thread tension is lower than at least one of the assumed thread tension and the adjusted thread tension, the diameter of the thread or yarn supply of the regulator is reduced by a supply-adjusting unit of the regulator.

31. Arrangement according to claim 30, wherein the regulator is adapted to receive said information for changing the size of the thread stock from the control unit when the actual thread tension deviates from at least one of the assumed thread tension and a latest thread tension read by the load cell.

32. Arrangement according to claim 29, wherein the information for changing the size of the thread stock brings about an increase in diameter in the thread or yarn supply of the regulator so that, if the actual thread tension is higher than at least one of the assumed thread tension and the adjusted thread tension, the diameter of the thread or yarn supply of the regulator is increased by a supply-adjusting unit of the regulator.

33. Arrangement according to claim 32, wherein the regulator is adapted to receive said information for changing the size of the thread stock from the control unit when the actual thread tension deviates from at least one of the assumed thread tension and a latest thread tension read by the load cell.

34. Arrangement according to claim 32, wherein the regulator and the load cell are included in a machine for weaving flat-woven wire.

35. Arrangement according to claim 29, wherein the regulator is adapted to receive said information for changing the size of the thread stock when the actual thread tension deviates from at least one of the assumed thread tension and a latest thread tension read by the load cell.

36. Arrangement according to claim 29, wherein the regulator and the load cell are included in a machine for weaving flat woven wire.

37. Arrangement according to claim 36, wherein a shuttle or projectile is arranged so as to perform the drawing out of the thread from the thread supply of the regulator.

38. Arrangement according to claim 29, wherein the control unit supplies a control signal to a supply-adjusting means of the regulator.

39. Arrangement according to claim 30, wherein, based on the pick-monitoring information, a signal is sent by the control unit to at least one of a stop circuit, the regulator, and an alarm panel.

40. A method of monitoring a drawn-out thread or yarn supply of a textile machine, the method comprising:

(a) providing the drawn-out length of thread or yam;

(b) determining a tension in the drawn-out length;

(c) sending a signal when the tension deviates from a desired tension; and (d) changing a size of a thread or yarn stock.

41. The method of claim 40, further comprising:

(e) pick monitoring the drawn-out length;

(f) sending a first signal when there is a discontinuity in the drawn-out length; and (g) sending a second signal when a gripping function is not operating.

42. The method of claim 40, further comprising:

(e) decreasing a diameter of the thread or yarn stock when the tension is higher than the desired tension; and (f) increasing the diameter of the thread or yarn stock when the tension is below the desired tension.

43. The method of claim 40, wherein said determining step is accomplished by a load cell which monitors the tension.

44. The method of claim 43, further comprising arranging the load cell at an exit of a regulator.

45. The method of claim 40, wherein said changing step includes using a regulator to change the size of the thread or yarn stock.

46. The method of claim 40, wherein said providing step includes arranging one of a projectile and a shuttle to draw out the thread from the thread supply.

47. The method of claim 40, further comprising receiving the signal in a control unit.

48. The method of claim 47, further comprising:

sending the signal received by the control unit to a regulator; and changing a diameter of the thread or yarn stock by adjusting the regulator in response to the signal.

49. A method of pick monitoring thread or yarn in a textile machine, the method comprising:

(a) sensing whether a drawn-out thread or drawn-out yarn is being produced;

(b) sending a first signal if the drawn-out thread or yarn is not produced;

(c) sensing whether the drawn-out thread or yarn is traversing;

(d) sending a second signal if the drawn-out thread or yarn is not traversing; and (e) providing a control signal to a regulator based on either of the first signal or the second signal.

50. The method of claim 49, wherein the providing step provides a stop signal to the regulator.

51. The method of claim 49, wherein the providing step provides a signal to activate an alarm.

52. The method of claim 49, wherein the providing step provides an information signal.

53. The method of claim 52, wherein the providing step provides the information signal as a stop signal sent to the regulator.

54. The method of claim 49, further comprising using a load cell to send either of the first signal or the second signal, or both, to a control unit.

55. The method of claim 49, further comprising receiving a stop control signal in a control unit and stopping the textile machine.

56. The method of claim 49, further comprising using a regulator to change a diameter of a thread or yarn stock.

* * * * *